US006289607B1

(12) United States Patent
Aaltonen et al.

(10) Patent No.: US 6,289,607 B1
(45) Date of Patent: Sep. 18, 2001

(54) FLOTATION DRYER UNIT AND METHOD OF USE

(75) Inventors: Rami Aaltonen; Roland Banecki, both of Turku; Pertti Heikkila, Raisio; Bertel Karlstedt, Kotka; Richard Solin, Kemio, all of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/424,654

(22) PCT Filed: May 29, 1998

(86) PCT No.: PCT/FI98/00453

§ 371 Date: Nov. 26, 1999

§ 102(e) Date: Nov. 26, 1999

(87) PCT Pub. No.: WO98/56985

PCT Pub. Date: Dec. 17, 1998

(30) Foreign Application Priority Data

May 30, 1997 (FI) ..... 972296

(51) Int. Cl.[7] ..... F26B 3/00

(52) U.S. Cl. ..... 34/508; 34/492; 34/638; 34/639; 34/640; 34/641; 34/643; 34/646; 34/652

(58) Field of Search ..... 34/487, 492, 508, 34/629, 638, 639, 640, 641, 643, 646, 652

(56) References Cited

U.S. PATENT DOCUMENTS

| | | | | |
|---|---|---|---|---|
| 2,616,188 | | 11/1952 | Steinfeld . | |
| 3,388,479 | | 6/1968 | Gardner . | |
| 3,964,656 | | 6/1976 | Hella . | |
| 4,021,931 | | 5/1977 | Russ et al. . | |
| 4,058,244 | | 11/1977 | Vits . | |
| 4,074,841 | | 2/1978 | Kramer et al. . | |
| 4,197,973 | | 4/1980 | Daane . | |
| 4,292,745 | | 10/1981 | Caratsch . | |
| 4,394,950 | | 7/1983 | Kramer . | |
| 4,719,708 | | 1/1988 | Karisson et al. . | |
| 4,779,357 | * | 10/1988 | Troetscher | 34/638 |
| 4,809,446 | * | 3/1989 | Langer | 34/640 |
| 5,016,363 | | 5/1991 | Krieger . | |
| 5,303,484 | | 4/1994 | Hagen et al. . | |
| 5,619,808 | * | 4/1997 | Pabst | 34/640 |

FOREIGN PATENT DOCUMENTS

| | | |
|---|---|---|
| 44-31666 | 12/1969 | (JP) . |
| 51-125508 | 11/1976 | (JP) . |
| 61-168776 | 7/1986 | (JP) . |
| 5-124047 | 5/1993 | (JP) . |
| 330 646 | 11/1970 | (SE) . |

* cited by examiner

*Primary Examiner*—Pamela Wilson
(74) *Attorney, Agent, or Firm*—Nixon & Vanderhye P.C.

(57) ABSTRACT

A method and flotation dryer unit effects drying of a web such as a coated paper web. The flotation dryer unit advantageously includes several nozzle boxes extending across the web for feeding drying air toward the web to be dried, a distribution chamber for drying air for leading the dry air into the nozzle boxes, and a suction chamber for gathering the drying air led toward the web from the web area and for directing it to the side of the web. The suction chamber is divided into an equalizing space and an air transport chamber by a perforated plate for equalizing the return air flow occurring from the web area.

22 Claims, 5 Drawing Sheets

FLOTATION DRYER UNIT AND METHOD OF USE

BACKGROUND

The present invention relates to a flotation dryer unit, described in the introduction of the enclosed independent claims, for drying a web, such as a coated paper web, and to a method for feeding drying gas or air towards the web to be dried in the flotation dryer unit.

The present invention especially relates to such flotation dryer units in which drying air is blown onto the web from air distribution channels, extending over the web and combined with supply air distribution chambers arranged on the side of the web.

Various kinds of flotation dryers or cylinder groups, lately also infra-dryers, are used for drying coated paper. The various drying methods have different advantageous features. The choice of dryer and the layout of drying may have an effect, for example, on the quality of the coated paper, energy costs, runnability of the paper web, layout of the coating machine in general (web path draw, space consumption etc.), and investment costs. At present, also combinations of various dryer types are thus used for achieving the optimum drying result, whereby the aim is to combine good properties of the various types.

In a flotation dryer, the evaporation of water from the web is typically achieved by hot air blown onto the web surface from nozzles. The specific evaporation of the flotation dryer is then principally dependent on the temperature and velocity of air blown and also on the type of nozzle used. Commonly used nozzle types comprise, for example, overpressure and underpressure nozzles, and also direct impingement and orifice nozzles.

Flotation dryers include the following good features: good runnability of paper; good energy economy; minimization of thermal stress in the machine room; double-sided drying possible; controlled drying as the impingement air velocities for the upper and lower sides may be adjusted separately; low risk of overdrying; and further, the structure of the dryer is long-standing and durable. However, the traditional flotation dryer has negative features compared with, for example, an infra-dryer: relatively low specific evaporation; relatively slow warming up of the web e.g. after a break; poorer control properties, i.e. poorer profiling; a lot space consuming; and relatively high investment costs.

In the last few years, attempts have been made to increase the evaporation efficiency of the flotation dryers in the papermaking industry by increasing the blow velocity for drying air from the typical velocity of 40 m/s to a velocity of 60 m/s, even to 80 m/s. Also the drying air temperature has been raised. However, increasing the blow velocity and raising the temperature also increase the size of the dryer, and thus the investment costs and space consumption. These changes also increase the energy consumption and they often have an impairing effect on the controllability.

The air distribution system arranged in the so-called air flotation dryer box of a traditionally constructed flotation dryer is a three-stage system, comprising superimposed air distribution channels both transverse and parallel to the web path, and nozzle channels transverse to the web path.

As blow velocities are increased, also the air volumes blown and, thus, the height of the air flotation dryer box become larger. In this case, the height of the air flotation dryer box typically is already about 1.60 m, with e.g. a web path width of 8.0 m and a blow air velocity of 60 m/s, the efficient length of the flotation dryer in the machine direction being about 2.4 m. Should one still wish to increase the blow velocity, the height of the air flotation dryer box would have to be increased still considerably more in order to keep the flow rates of air in the three-stage air distribution system within the limits permitted by the design, which might, in many cases, cause insurmountable difficulties.

The space consumed by the large height of the air flotation dryer boxes makes it more difficult and, sometimes even impossible, to fit the flotation dryer in connection with a coating machine. Today, the space consumption is to a very large extent also a matter of cost; the smaller the space the dryers may be fitted into, the better.

Thus, it has been proposed, as is apparent, for example, from the American patent publications U.S. Pat. No. 3,964,656; U.S. Pat. No. 4,021,931; and U.S. Pat. No. 4,719,708, that various web floating means with a two-stage air distribution system be used, in which the air is led to nozzle channels travelling across the web path directly from the side of the web path. Thus the size and height of the air flotation dryer box may be kept considerably smaller.

The problem with these arrangements provided with a two-stage air distribution system is, however, how to distribute the impingement air onto the web in an even and controlled way and how to discharge return air evenly from the web. Upon discharging from the nozzles onto the web, drying air flowing over the web with a high velocity causes vibrations and flutter in the web and tends to move the web in the lateral direction. These kinds of movements disadvantageous for the runnability are generated in the web especially in high speed machines or when drying light grade of papers. Also uneven discharge of air from the web area generates unwanted air flows and pressure variations in the vicinity of the web.

SUMMARY OF THE INVENTION

An object of the invention is thus to provide a flotation dryer unit and a method for drying the web in a flotation dryer unit, in which the aforementioned drawbacks present in known arrangements are minimized.

An object of the present invention is thus especially to provide a flotation dryer unit in which it is possible to use higher drying air velocities than before for achieving a good specific evaporation efficiency without impairing the runnability.

In addition, it is an object of the invention to provide a flotation dryer unit with good runnability and of a relatively simple and light structure, which warms up and reacts quickly to heat adjustment.

It is further an object of the invention to provide a flotation dryer unit of simple structure, in which drying air and return air travel as linearly as possible and in which pressure losses and energy consumption are thus minimized.

It is also an object of the invention to provide a flotation dryer arrangement which consumes little space and which may easily be joined to a variety of coating machines.

A typical flotation dryer unit provided with a two-stage air supply for drying a coated paper web comprises nozzle boxes arranged on one side or on both sides of the paper web to be dried and extending across the web, from which drying air is blown onto the web. Air is brought to the nozzle boxes from a distribution chamber for supply air which is common for the nozzle boxes and which lies on the side of the dryer; air flows from the distribution chamber to the nozzle boxes from their supply ends. The drying air used, i.e. return air, flowing between the nozzle boxes away from the web, is gathered from the entire back side surface area of the dryer via a common suction chamber covering the nozzle boxes into a return air chamber, to be taken forward therefrom.

The air nozzle boxes are typically formed of longitudinal box-type structures, extending over the web, and comprising a bottom part parallel to the web plane, two side walls typically perpendicular to the web plane and extending across the web, and an inclined planar upper part. Due to the inclined upper part, the nozzle boxes decline in a wedgelike manner in the direction of the air flow.

The actual nozzle elements extending across the web are integrated into the air distribution channel elements extending principally across the web in the nozzle boxes; the nozzle elements include at least one nozzle aperture or slot, from which drying air is fed/blown towards the web. Many types of nozzles may be used in the nozzle boxes, preferably e.g. overpressure nozzles, such as Float nozzles of the applicant. Also underpressure nozzles, direct impingement nozzles or orifice nozzles may be used.

In an advantageous flotation dryer arrangement of the invention, the height h of the air distribution channels for the nozzle boxes perpendicular to the web declines from the supply end of the nozzle channel towards its tail end so that the nozzle boxes are wedge-shaped, i.e. their height decreases in the flow direction. Thus, an even air supply is achieved in the entire area of the flotation dryer unit.

Return air is led from the web area into a suction chamber covering the nozzle boxes, and further into a common return air chamber on the side of the dryer; the return air chamber is typically arranged at least partially on top of the supply air distribution chamber. In this case, also the suction chamber preferably is wedge-shaped so that its height increases in the flow direction of return air, i.e. it declines from the first side of the web to the second side.

Due to the wedge-shaped form of the nozzle boxes and the suction box, the entire flotation dryer box is wedgelike. Irrespective of this, the two-stage dryer is considerably lower than a conventional three-stage dryer, in which supply air is led to the actual nozzle apertures through channels arranged in three separate levels.

In the arrangement of the invention, the runnability of the flotation dryer is further improved by preventing the lateral flows of return air also, which is absorbed from the web area to the space between the nozzle boxes, and by equalizing the discharge of return air from the web area. Return air is gathered evenly in directions both transverse and parallel to the travelling direction of the web. An even flow of return air is achieved by arranging a perforated plate into the suction chamber so that the suction chamber is divided into

- an equalizing space surrounding the air distribution channels in the space being formed between the perforated plate and the web;
- a transport chamber being formed between the perforated plate and the back side surface of the suction chamber.

For achieving a desired, even suction pressure profile, the open area of the perforated plate is dimensioned so that return air is discharged evenly from the entire dryer area through the perforated plate; whereby it is possible to avoid flows and pressure variations in the vicinity of the web, which are caused by uneven gathering of return air.

The open area of the perforated plate is typically under 15%, depending on the size of the suction chamber and the air blow velocity of the nozzles. In a wedge-shaped suction chamber, it is preferable to arrange a larger open area in the perforated plate in the declining section of the suction chamber than in the higher level section, so that the open area may vary even extensively in the different sections. When necessary, the perforated plate dividing the suction chamber may be formed of several elements, modules, arranged in succession in the transverse direction of the web. The declining section of the suction chamber is then provided with a perforated plate element, or module, which has larger apertures or a larger number of apertures than the perforated plate element arranged in the vicinity of the suction box exit.

Now it has also been noticed that, in a two-stage dryer, in which drying air is led directly from the side of the web to a nozzle box extending over the web or to an air distribution channel, the flow component of impingement air discharging from the nozzles laterally to the web has a considerable effect on the behavior of the web in the flotation dryer. It has been found that straightening the lateral flow component furthers the runnability of the flotation dryer unit.

In a preferred flotation dryer unit of the invention, the nozzle element is thus provided with a so-called straightening passage, with straightening elements for the drying air flow fitted within, for eliminating or substantially reducing such velocity component of the drying air flow fed towards the web through the nozzle, that are directed laterally to the travel direction of the web. With this arrangement, it is possible to prevent the continuation of the effect of the axial velocity component of drying air flowing in the nozzle boxes still in the air flow discharging from the nozzle aperture, slot or holes. With the arrangement of the invention, upon discharging air from the nozzle aperture, drying or impingement air is directed to flow so that its velocity component projected to the web plane is parallel to the travel direction of the web or that it forms an angle with the travel direction of the web which is smaller than a marginal angle, e.g. of ±5°.

The straightening elements are typically formed of several straightening channels arranged sequentially in the transverse direction of the web, in which the flow is typically arranged to travel principally perpendicularly to the web plane or in a small angle to the web plane in a plane which is parallel to the travel direction of the web and principally perpendicular to the web plane. In vertical direction, the straightening channels have to be sufficiently long and narrow so that the desired straightening effect will be achieved.

The straightening passage for the nozzle part is preferably arranged in a slot limited by two wall elements parallel to the nozzle box and extending across the web. The passage is provided with several separate and sequential straightening channels across the web by partitions extending from one wall element to the other. The wall elements are advantageously formed of an edge portion closest to the web of the nozzle box side wall, or of a parallel plate-like element attached to it. The wall elements are advantageously arranged principally perpendicularly to the web plane and the travel direction of the web but, if desired, they may also be inclined.

The partitions forming the straightening channels in the straightening passage may typically be formed of a plate profile parallel to the nozzle element, such as a so-called fluted sheet, which is arranged into the slot between the wall elements and bent to reciprocate in the slot and across the slot from one wall element to another. One fluted sheet may be long and folded several times to form several sequential straightening channels. On the other hand, the straightening channels may be formed of sequential pieces of plate, each of them forming only one or two partitions in the straightening passage.

The edge portions of the nozzle channel side walls, facing the web, or the parallel plate-like elements joined to them, typically have an extension extending from the plane of the bottom portion towards the web, forming an angle of <90° with the planes of the bottom portions of the nozzle elements, and forming the actual nozzle aperture. The straightened gas flows coming from the straightening channels discharge in the nozzle apertures in a way known per se principally from a direction perpendicular to the web to flows parallel to the web.

Also the return air flow may be adjusted by using flow straighteners fitted between the nozzle boxes which may be fluted sheets of the type described above.

The invention is above explained in an exemplary way by referring to preferred embodiments of the invention, in which the flotation dryer arrangement of the invention is used for drying and heating a coated paper web by hot air. The invention is naturally applicable in other similar connections, for example, if the web is desired to be treated with some other appropriate blowable gas than air. The invention may also be used when cooling down the web with blast air or some other gas.

The flotation dryer unit of the invention may be single-sided so that the flotation dryer unit or units are arranged on one side of the web or, alternatively, double-sided so that flotation dryer units are arranged opposite each other on both sides of the web. If desired, it may also be considered to use sequentially both flotation dryer units and infra-dryer units for drying the paper web. On the other hand, flotation dryer units may also be arranged in a cylinder dryer to blow against the cylinder surface so that nozzles are placed in an arched form corresponding to the radius of the cylinder.

With the arrangement of the invention, it is possible to considerably improve those properties of the flotation dryer which are poorer in a conventional flotation dryer than in an infra-dryer. With the invention, the size and investment costs for the flotation dryer may thus be considerably reduced, and it is possible to increase its specific vaporization efficiency and enhance its control properties.

With the described two-stage structure, in which the air distribution channels and nozzle parts of the flotation dryer are integrated into each other as wedge-like nozzle boxes extending across the web and which is provided with a straightening of impingement air, an arrangement with a substantially lower structure than the previously used three-stage air-borne web-dryers is achieved. In a dryer corresponding to the two-stage structure, the height of the air flotation dryer box would be approximately 1.2 m on the drive side and about 0.5 m on the tender side, the web path width of the dryer being 8 m, the length of the flotation dryer 2.4 m, and the blowing velocity 60 m/s; this is very preferable when opening the boxes during a shutdown or a break of the web. The flotation dryer unit of the invention may thus be placed into smaller spaces than before.

Because of the straightening elements fitted into the nozzle elements of the nozzle boxes, air may, in the arrangement of the invention, be distributed evenly by a simple nozzle box structure, the investment costs of which are low, even at high blowing velocities and temperatures, i.e. with regard to large volumes of air. Also the fact, that the specific evaporation efficiency may be increased by increasing the blowing velocities without the structure of the flotation dryer becoming too big, may also be considered to be an important advantage of the invention.

Due to its relatively small size, i.e. low structural mass, the flotation dryer unit shown also reacts sensitively to the adjustment of temperature. The flotation dryer warms up is quickly, for example, upon starting and after a break of the web. A further advantage is that the flotation dryer unit operates with a smaller pressure loss than the previous three-stage arrangements so that blowing velocity is achieved with less energy. This is due to the simple two-stage structure which allows supply air to flow relatively directly from the air distribution chamber to the nozzle apertures.

BRIEF DESCRIPTION OF THE DRAWINGS

The invention is next described in more detail, referring to the enclosed drawings in which.

DETAILED DESCRIPTION OF THE PREFERRED EMBODIMENTS

Figure 1:
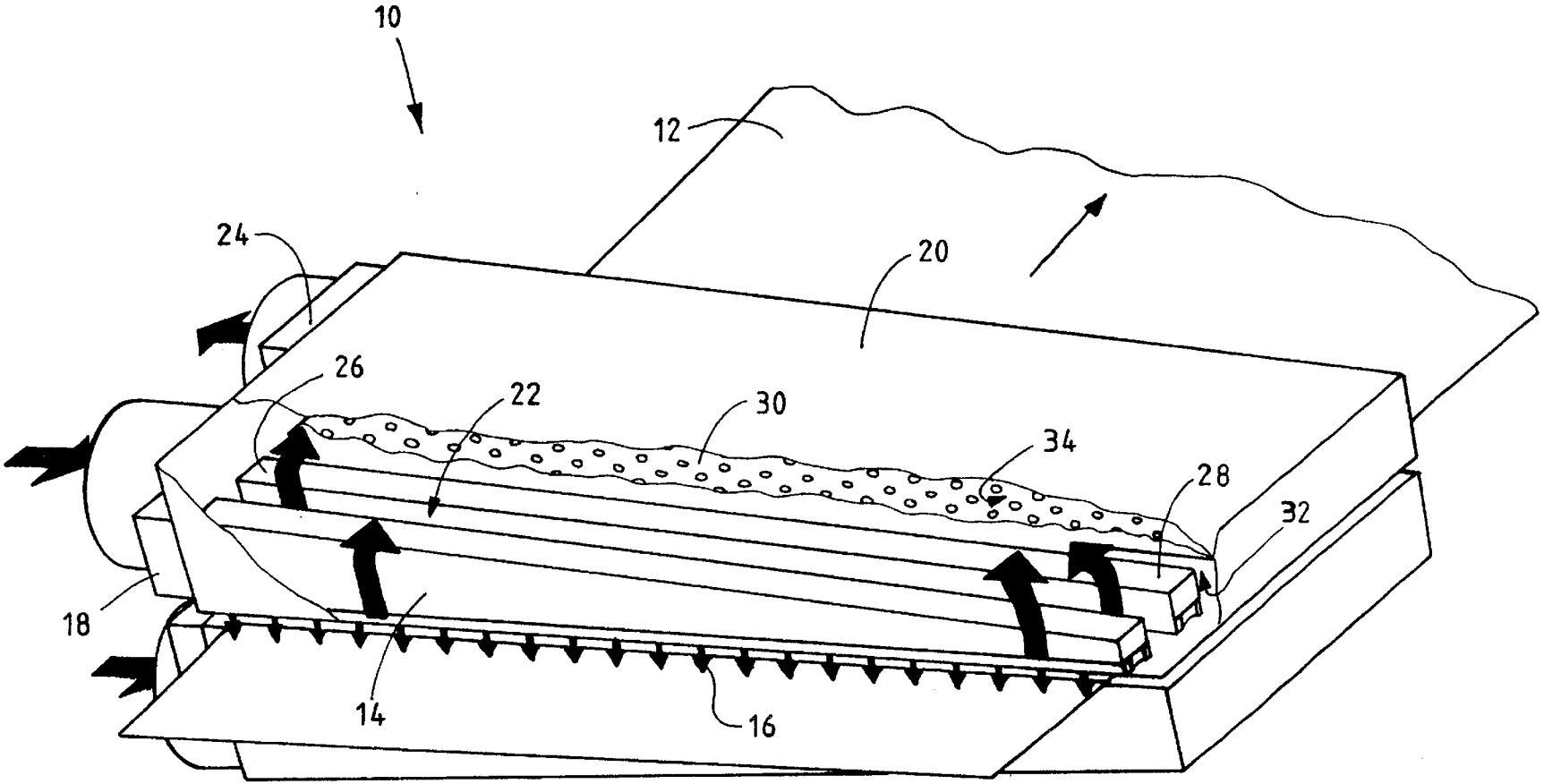
FIG. 1 is an exemplary, schematic, partially cut-away perspective view of a flotation dryer unit of the invention.

FIG. 1 presents a flotation dryer unit 10 of the invention for drying the coated web 12. The flotation dryer unit comprises several nozzle boxes 14 arranged across the web, through which drying air jets 16 are fed towards the web. The supply air distribution chamber 18 at the side of the web is common to all of the nozzle boxes 14 in the unit. The nozzle boxes 14 are covered with a box-like structure opening towards the web and forming the suction chamber 20 for air being discharged from the web. The box-like structure of the suction box covers the nozzle boxes 14, however, leaving a free space for the discharge of return air above the nozzle channels. Air is discharged from the web area, as shown by big arrows, from the space 22 between the nozzle boxes to the upper part of the suction chamber and further to the gathering chamber 24 for return air on the side of the web.

The nozzle boxes 14 are wedge-shaped, their height decreasing from the entry end 26 towards the tail end 28, i.e. in the flowing direction of supply air. In this case, also the suction chamber 20 covering the nozzle boxes is slightly wedge-shaped so that the height H of the suction chamber (FIG. 2) increases in the flowing direction of return air. The entire air flotation dryer box is thus wedge-shaped but, however, its height is considerably smaller than a corresponding, conventional three-stage flotation dryer structure.

In accordance with the invention, the suction box 20 is divided into two parts by a perforated plate 30 equalizing the flow of return air: to an equalizing space 32 between the perforated plate 30 and the web 12, and to a transport chamber 34 between the perforated plate and the back side surface of the suction chamber 20. Both the equalizing space 32 and the transport chamber 34 are, in the case shown in FIG. 1, wedge-shaped so that their height increases in the direction of the flow.

Figure 2:
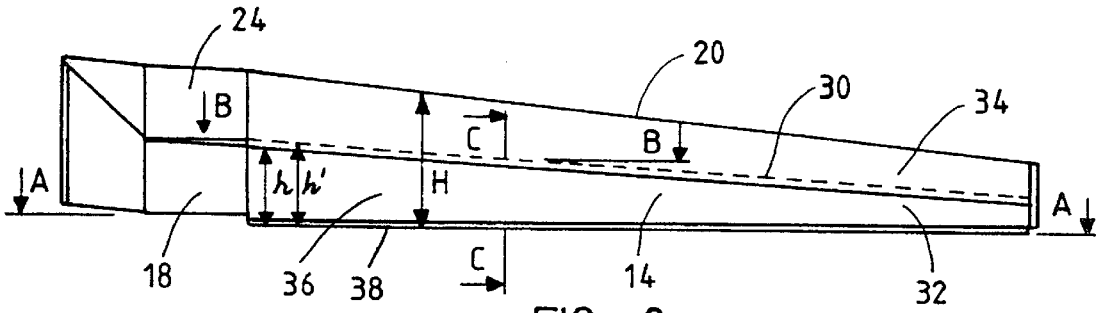
FIG. 2 is a schematic, vertical section of an air flotation dryer box of the flotation dryer unit of FIG. 1 in the transverse direction of the web.

FIG. 2, in which the same reference numbers are used as in FIG. 1, presents a cross-section of the flotation dryer unit 10 of FIG. 1 taken in the transverse direction of the web in the space 22 between the nozzle boxes. FIG. 2 describes in a better way than FIG. 1 how the perforated plate 30, extending from one side of the web to the other, divides the suction chamber 20 into an open equalizing space 32 between the web and the perforated plate and into the transport chamber 34 remaining between the perforated plate and the back side surface of the suction chamber 20. In the suction chamber, the perforated plate forms a pressure equalizer thus providing an even flow of return air in the entire web area.

The nozzle box 14 is shown in a side view in FIG. 2. It is also seen that the perforated plate 30 is arranged into the suction chamber within a small distance of, for example, 50–70 mm, above the nozzle boxes and principally parallel to the upper surface of the nozzle boxes 14. The height h of the nozzle boxes 14 and the height h' of the equalizing space 32, which is slightly bigger than h, increase in the flow direction of return air principally in the same proportion. The wedge-like shape of the cross-section of the nozzle boxes 14 and the equalizing space 32 is thus principally the same. FIG. 2 also shows that the air transport chamber 34 is wedge-shaped, opening in the direction of the return air flow.

It may also be seen in FIG. 2 that the nozzle channel 14 is formed of an actual air distribution channel element 36 and an actual nozzle element 38 below the air distribution channel element.

Figure 3:
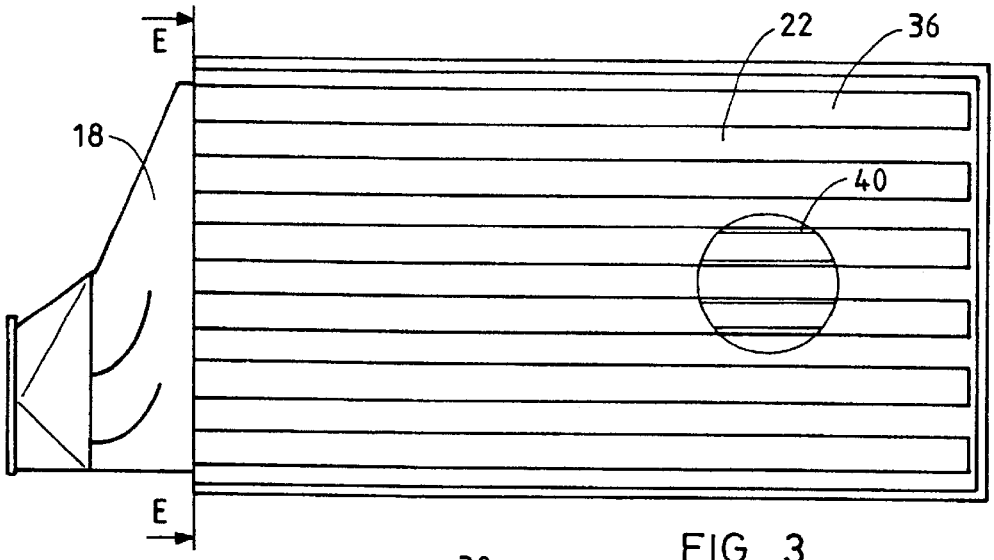
FIG. 3 is a section of FIG. 2 in accordance with the line AA.

FIG. 3 shows a section of the actual nozzles 38 of FIG. 2 in the direction of the web plane along the line AA. In FIG. 3, there is shown a cross-section of six air distribution channels 36 extending across the web. The air distribution channels are connected to a common supply air distribution chamber 18. Hot air, or some other appropriate gas, is supplied to the flotation dryer through the air distribution chamber, either directly from the source of hot air, or as circulating air after conditioning of the return air.

Figure 4:
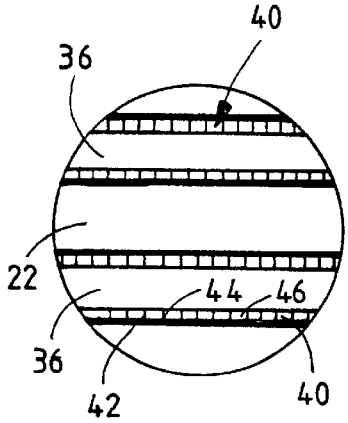
FIG. 4 is an enlarged view of the detail shown with a circle.

FIG. 4 shows the encircled area of FIG. 3, in which there are two air distribution channels 36 and an intermediate space 22. Also straightening passages 40 are marked in the air distribution channels 36. The straightening passages are provided with profile plates 42, e.g. fluted sheets parallel to the passage. The profile plates are bent so that the plate extends from one wall of the straightening passage to the other, thus forming partitions 44 in the passage. The partitions 44 divide the passages 40 into separate straightening channel elements 46. The said channel elements 46 divide the drying air flowing along the air distribution channel 36 into successive, separate air jets 16 flowing towards the web and shown in FIG. 1.

Figure 5:
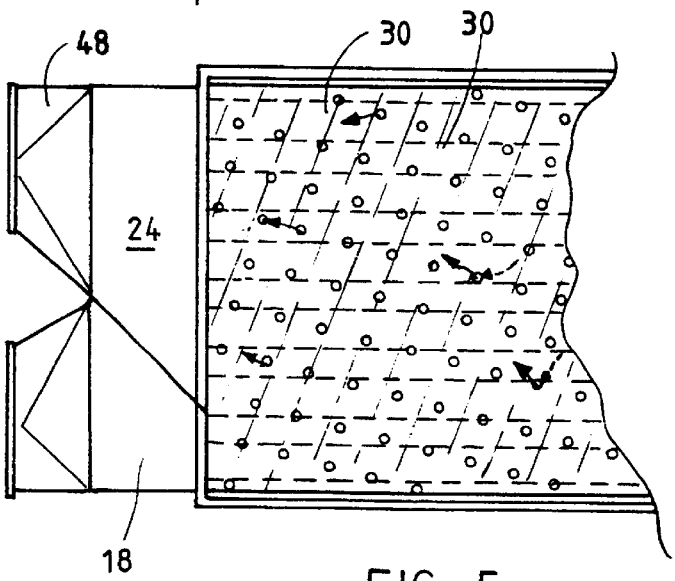
FIG. 5 is a section of FIG. 2 in accordance with the line BB.

FIG. 5 shows the cross-section of the suction chamber 20 of FIG. 2 along the line BB. In the Figure, there is shown the perforated plate 30 between the transport chamber of the suction chamber and the equalizing space, with apertures 30'. Return air in accordance with the arrows flows from the apertures 30' towards the gathering chamber 24 for return air, from which return air is further led to the discharge channel 48.

The size, number and reciprocal distance of the apertures or openings in the perforated plate, may be calculated if the amount of air discharging from the web and the width of the web are known. The open area is typically less than 15%, which may be achieved, for example, with openings of 5–75 mm, preferably of 10–40 mm. However, the open area of the perforated plate may vary in the transverse direction of the web so that the open area decreases in the flowing direction of return air.

Figure 6:
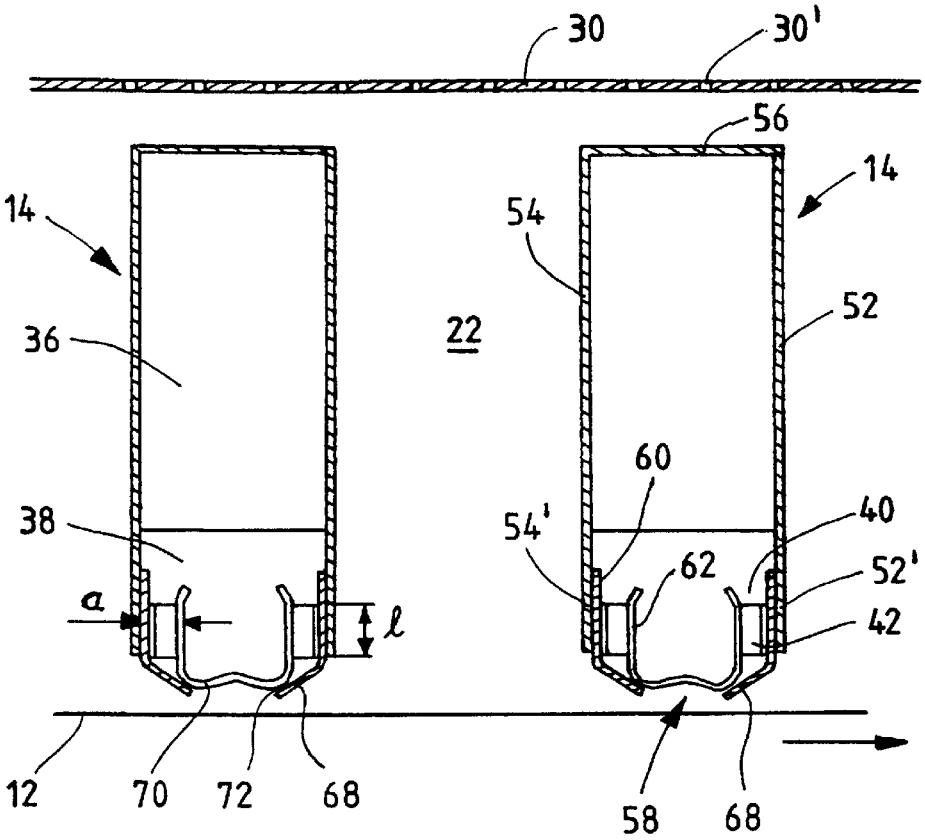
FIG. 6 shows an enlarged part of a section of FIG. 2 in accordance with the line CC.

FIG. 6 presents a cross-section of two boxes 14 parallel to the travelling direction of the web. Each nozzle box has a box-like structure, and is formed of two side walls 52, 54 extending across the web, of an upper part 56, which is inclined in the longitudinal direction, and of a bottom part 58. The inclination of the upper part 56 may be seen in FIGS. 1 and 2. The nozzle box consists principally of two parts, comprising an air distribution channel 36 and an actual nozzle element 38 which is integrated into the air distribution channel.

The nozzle element 38 is provided with straightening passages or slots 40 extending across the web. The straightening passages 40 are defined by planar wall elements 60 across the web and joined to the web side lower edges 52', 54' of the side walls 52 and 54 and parallel to the said edge, and by second parallel planar wall elements 62 fitted into the nozzle element. The edges of the side walls 52 and 54 of the nozzle boxes may, if desired, be directly used as wall elements defining the straightening passage 40. The nozzles in FIG. 6 are overpressure nozzles of the so-called Float type.

The straightening passages 40 are provided with elements 42 straightening the supply air flow; the said elements divide the straightening passage into successive channel parts 46 by forming partitions 44, as is shown in FIG. 4.

The distance a between the wall elements 60 and 62 of the straightening passage 40 is about 10–40 mm, preferably 15–25 mm. The height l of the straightening elements 42 arranged in the straightening passage 40, i.e. the depth of the straightening channel, is about 30–100 mm, preferably 40–60 mm.

In addition, extensions 68 are provided to the planar elements 60, the extensions together with the inner part 70 of the nozzle forming the actual nozzle apertures 72, from which the straightened drying air is discharged towards the web 12.

FIG. 6 further discloses a perforated plate 30 of the invention provided with openings 30' and arranged above the nozzle boxes 14. In accordance with the invention, the perforated plate adjusts the return air flow via the spaces 22 between the nozzle boxes.

Figure 7:
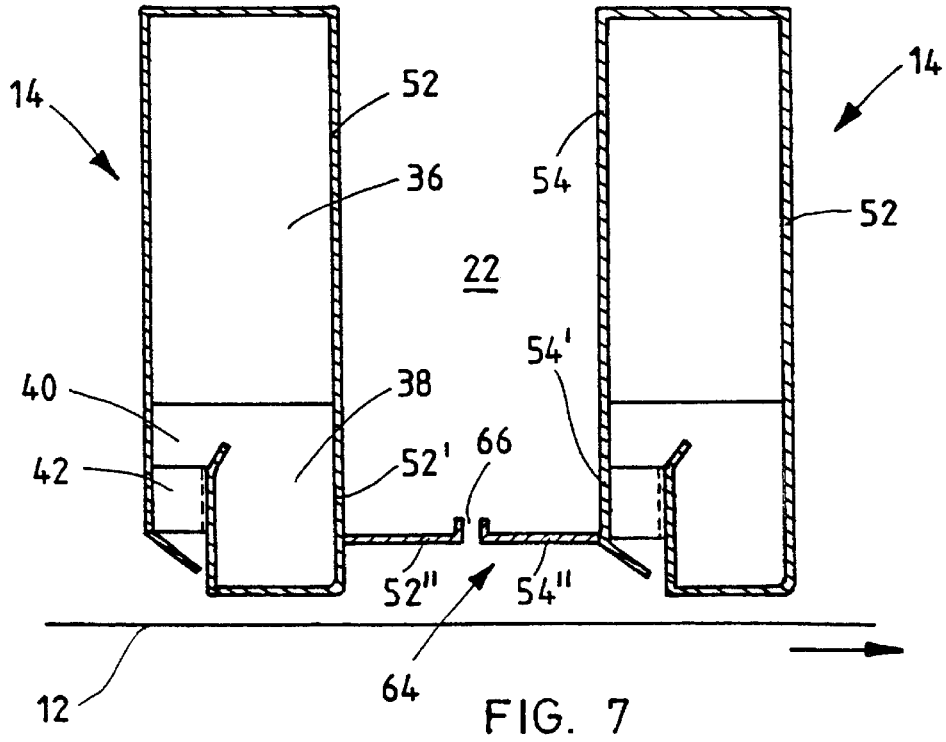
FIG. 7 is a section of a second air flotation dryer box of the invention in accordance with FIG. 6.

FIG. 7 presents a cross-section in accordance with FIG. 6 of two underpressure nozzles of the Foil type. In this arrangement, the nozzle element 38 has only one straightening passage 40, which is provided with an air flow straightening element 42 for bringing air towards the web 12 in a controllable way.

Extensions 52", 54" of the part of the nozzle box side walls 54 and 52 facing the web are, in the application of FIG. 7, bent to form a plane 64 parallel to the plane of the supporting surface of the nozzle or to the web plane in the space 22 between the adjacent nozzle boxes. The extensions 52", 54" form between them a return air gap 66 extending preferably across the web, from which return air smoothly flows into the space 22 between the nozzle channels. The return air gaps may be provided with a flow straightening element.

Figure 8:
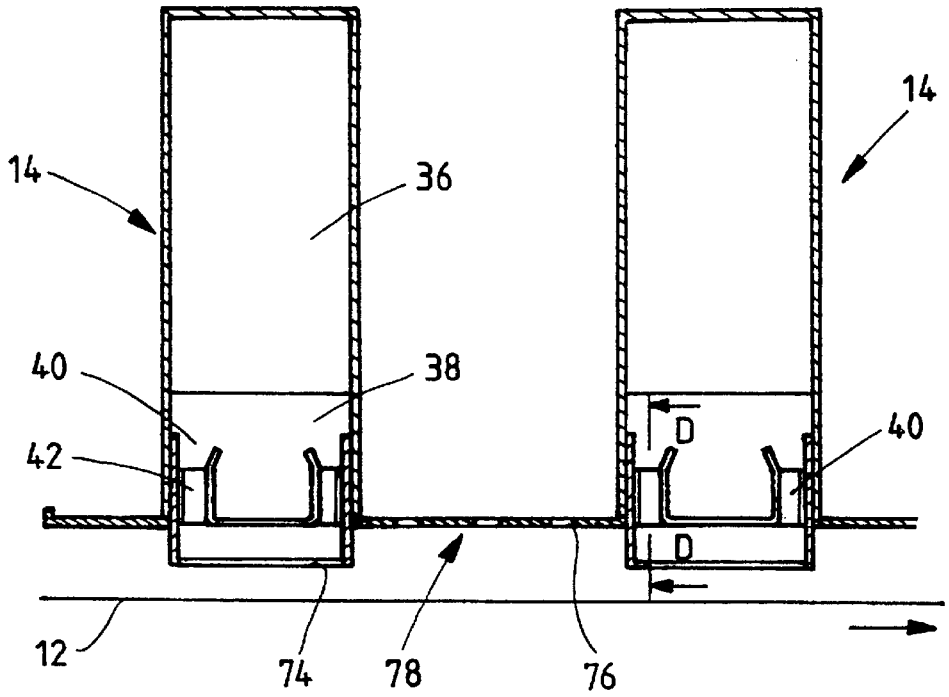
FIG. 8 is a section in accordance with FIG. 6 of a third air flotation dryer box of the invention.

FIG. 8 presents a cross-section in accordance with FIG. 6 of two nozzle boxes 14 known in themselves, a perforated plate 74 forming the actual nozzle apertures in the bottom part of the boxes. A grate or a perforated plate 78 with a large open area is arranged between the nozzle boxes to prevent paper strips from flowing into the suction chamber. The open area of the grate may be, for example, about 55%, which may be achieved with large openings 76 of, for example, about 30×30 mm arranged with intervals of, for example, 20–40 mm. The grate in FIG. 8 may also advantageously be arranged, for example, between the nozzle boxes shown in FIG. 6. The different intermediate space arrangements for nozzle boxes shown in FIGS. 6, 7 and 8 are also naturally suitable to be used in connection with also other types of nozzles than those shown in the particular figures.

Figure 9:
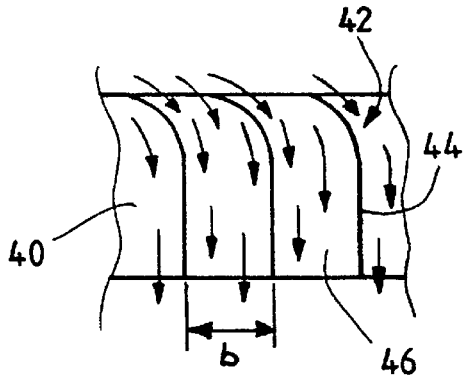
FIG. 9 is a section of FIG. 8 along the line DD.
Figure 10:
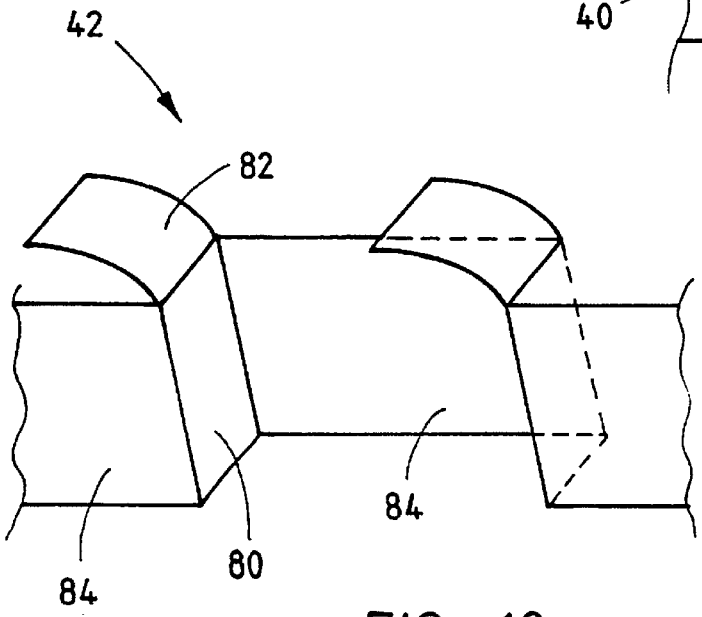
FIG. 10 is a schematic perspective view of a part of a straightening element available in the arrangement of the invention.

FIGS. 9 and 10 show in more detail the structure of an advantageous straightening element 42 of the invention. FIG. 9 presents a cross-section along the line DD of the straightening passage 40 in FIG. 8, which is provided with straightening elements 42 with a curved entrance. The parts 44 extending across the passage 40 of the straightening elements 42 form partitions in the passage, thus dividing the passage into straightening channels 46.

In the case shown in FIG. 9, the partitions 44 are made arched in the incoming direction of the flow, parallel to the flow, as is shown by the arrows indicating the flow. The distance b between the partition walls is about 10–100 mm, typically about 20–50 mm. In this case, air flows along the arch of the partitions without "disengaging" from them and without creating turbulence in the straightening channels 46 to a disturbing extent.

The partition arrangement in accordance with FIG. 9 is achieved with a straightening element 42 shown in FIG. 10. The straightening element 42 consists of a plate which is bent to alternately travel across the passage and along either wall of the passage. The parts 80 travelling across the passage are provided with extensions 82 directed towards the incoming air flow, the extensions being bendable so that they follow the direction of the air flow. In the arrangement shown in FIG. 9, the parts 84 travelling along the walls are longer in the flow direction than the parts 80 travelling across the passage, but, if so desired, they may also be shorter.

The drying air flow coming from the air distribution chamber is accelerated because of flow contraction caused by openings 88 between the air distribution chamber 18 and the air distribution channels 36. The said acceleration in the supply air flow immediately after the inlet openings of the nozzle boxes may, in some cases, cause an insufficient velocity in the nozzle impingement profile in the first part of the nozzle box. By dividing air from the supply air distribution chamber 18 into distribution channels 36 in an appropriate way, the said reduction in velocity may be compensated.

Figure 11:
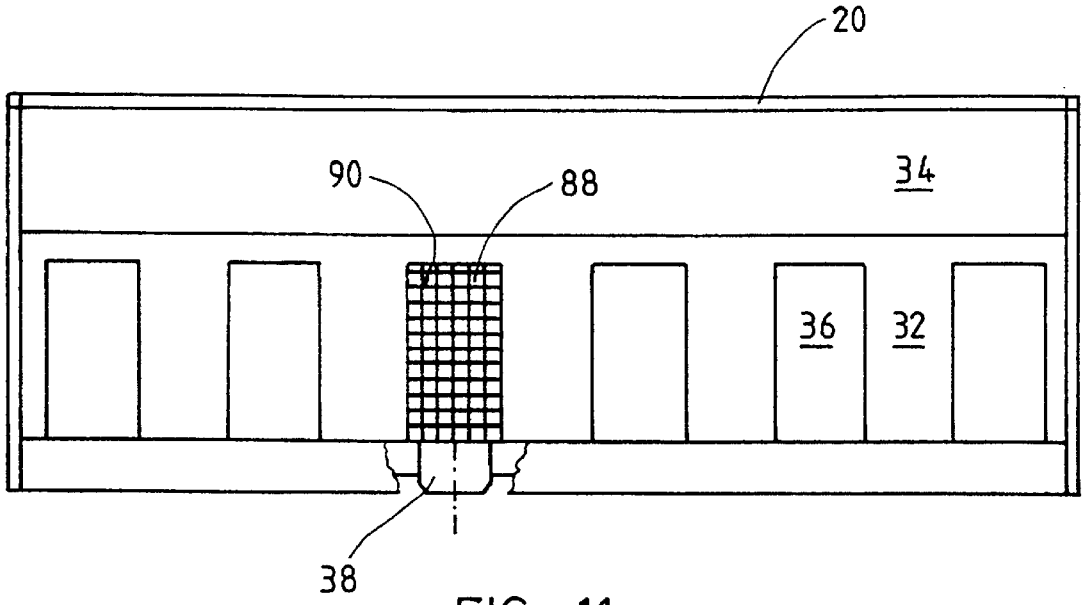
FIG. 11 is a cross-section of FIG. 3 along the line EE.
Figure 12:
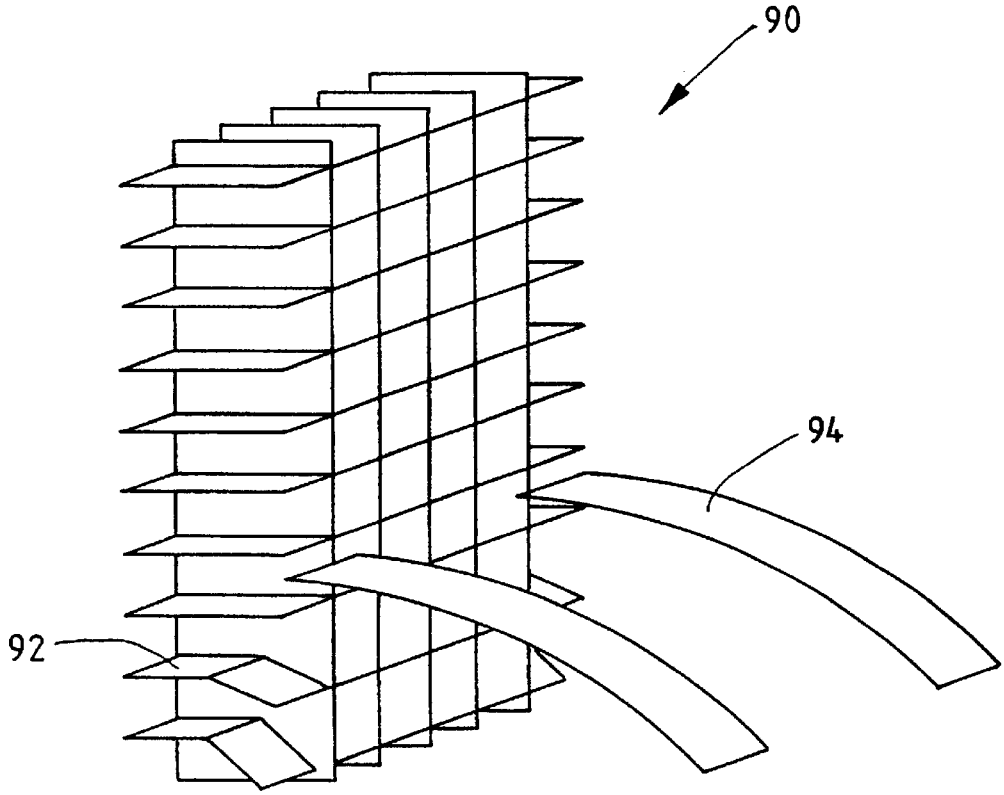
FIG. 12 is an enlarged view of a grate shown in FIG. 11 and seen diagonally from the side.

FIG. 11 thus schematically shows a section along the line EE taken from the wall between the supply air distribution chamber 18 and the suction chamber 20 shown in FIG. 3. The opening 88 is in an exemplary way provided with a grate 90 for reducing the contraction of the entry flow into the air distribution channel 36. In FIG. 12, the grate 90 is shown enlarged and seen diagonally from the side. The width of the grate is chosen taking into consideration the velocity of the incoming flow, the width of the nozzles and the length of the nozzles. The width of the grate apertures is typically about 30 mm, and the length about 80 mm, but the measures may vary according to need.

The lower plates 92 of the grate may be shaped to direct the flow downwards so that they force part of the air flow coming into the air distribution channel to flow towards the actual nozzle 38 immediately after the opening. When desired, longer guiding plates 94 may be joined to the grate, forcing part of the air flows to turn towards the nozzles. The guiding plates may be arranged to the height of, for example, about 80–180 mm, preferably about 135 mm. The total length of the guiding plates and the grate may be about 400 mm.

In the two-stage arrangements of the invention described above, in which the nozzles 38 are integrated into parallel air distribution channels 36 extending across the web, the nozzles may be made easily detachable and changeable. The nozzles may be supported at the inlet end for supply air, i.e. at the drive side, and they may be arranged to be suspended on the tender side. The replaceability of the nozzles is especially important in drying processes in which the nozzles easily get dirty and in which they have to be cleaned in regular intervals.

The invention is above described referring to the enclosed drawings. However, it is not in any way intended to limit the invention to the exemplary arrangements and embodiments. On the contrary, the purpose is to widely apply the invention within the scope defined by the enclosed claims.

What is claimed is:

1. A flotation dryer unit for drying a web, the flotation dryer unit comprising:

at least two nozzle boxes extending across the web and arranged one beside another along a travelling direction of the web for feeding drying gas toward the web to be dried, the nozzle boxes comprising:

air distribution channels extending across the web, the air distribution channels having a supply end on a first side and a tail end on a second side of the web, and a nozzle element joined to each of the air distribution channels for feeding drying gas from the air distribution channels toward the web;

a distribution chamber for drying gas joined to the supply ends of the air distribution channels, for directing drying gas to the nozzle boxes; and a suction chamber for gathering drying gas fed toward the web and for discharging the drying gas from the web area, wherein the nozzle boxes are covered with a box structure opening toward the web and forming the suction chamber, and wherein the suction chamber is divided by a perforated plate disposed at a distance above the nozzle boxes, into (1) an equalizing space formed between the perforated plate and the web and surrounding the air distribution channels, and (2) a transport chamber formed between the perforated plate and a back side surface of the suction chamber.

2. A flotation dryer unit according to claim 1, wherein the nozzle boxes decrease in height in a flowing direction of drying air so that a height (h) of the nozzle boxes perpendicular to the web decreases from the first side of the web when travelling toward the second side.

3. A flotation dryer unit according to claim 2, wherein the air distribution channels decrease in height from the supply ends toward the tail ends.

4. A flotation dryer unit according to claim 1, wherein in a transverse cross-section of the web, the suction chamber is wedge-shaped so that a height (H) of the suction chamber decreases from the first side to the second side.

5. A flotation dryer unit according to claim 4, wherein at least one of (1) a height of the equalizing space decreases from the first side of the web to the second side of the web, and (2) a height of the transport chamber decreases from the first side of the web to the second side of the web.

6. A flotation dryer unit according to claim 1, wherein an open area of the perforated plate increases from the first side of the web to the second side of the web.

7. A flotation dryer unit according to claim 1, wherein the suction chamber is joined to a gathering space for return air on the first side of the web, the gathering space being fitted onto the distribution chamber for supply air.

8. A flotation dryer unit according to claim 1, wherein the nozzle element has at least one straightening passage, which has flow straightening elements provided within for at least one of eliminating and substantially reducing a velocity component of the flow of drying gas fed toward the web and being transverse to the travelling direction of the web.

9. A flotation dryer unit according to claim 8, wherein the straightening elements form several successive straightening channels in a transverse direction of the web, in which the flow is arranged to be led toward the web.

10. A flotation dryer unit according to claim 8, wherein the straightening passage is a gap restricted by two wall elements parallel to the nozzle channel, and wherein the straightening elements are formed from partitions extending from the first wall element of the nozzle aperture to the second wall element.

11. A flotation dryer unit according to claim 10, wherein the straightening elements comprise a plate profile that is fitted in the gap between the wall elements and bent to reciprocate in the gap across the gap from one wall element to the other.

12. A flotation dryer unit according to claim 10, wherein a reciprocal distance of the wall elements is about 10–40 mm, wherein a depth of the gap in a direction of the drying gas flow is about 30–100 mm, and wherein a mean distance between the partitions in a longitudinal direction of the gap is about 10–100 mm.

13. A flotation dryer unit according to claim 10, wherein the wall elements are arranged perpendicularly to the web and perpendicularly to the travelling direction of the web.

14. A flotation dryer unit according to claim 10, wherein a length of the wall elements principally corresponds to a width of the web.

15. A flotation dryer unit according to claim 10, wherein each nozzle box comprises an elongated box structure extending over the web, which has a bottom part forming a supporting surface parallel to a plane of the web, two side walls extending across the web principally perpendicularly to the web plane, and an inclined upper part, and wherein an edge part closest to the web of at least one side wall forms the second wall element for the straightening passage.

16. A flotation dryer unit according to claim 10, wherein a reciprocal distance of the wall elements is about 15–25 mm, wherein a depth of the gap in a direction of the drying gas flow is about 40–60 mm, and wherein a mean distance between the partitions in the longitudinal direction of the gap is about 20–50 mm.

17. A flotation dryer unit according to claim 1, wherein a flotation dryer unit is arranged both above and below the web.

18. A method for drying a web in a flotation dryer unit, the flotation dryer unit including:

at least two nozzle boxes extending across the web and arranged one beside another along a travelling direction of the web, wherein the nozzle boxes comprise air distribution channels extending across the web, having a supply end and a tail end, and nozzle elements joined to each air distribution channel;

a distribution chamber for drying gas joined to the supply ends of the air distribution channels; and a suction chamber, wherein the method comprises:

feeding drying gas into the air distribution channels of the nozzle boxes from the drying gas distribution chamber;

blowing drying gas from the air distribution channels toward the web to be dried through the nozzle elements for drying the web; and discharging gas from an area of the web into the suction chamber wherein the flow of gas from the web area to the suction chamber covering the nozzle boxes of the flotation unit and opening toward the web is adjusted by restricting the flow of gas through the suction chamber by a perforated plate, which is disposed at a distance above the nozzle boxes and arranged to divide the suction chamber into (1) an equalizing space surrounding the air distribution channels and formed between the perforated plate and the web, and (2) an air transport chamber formed between the perforated plate and a back surface of the suction chamber.

19. A method according to claim 18, comprising using hot air as drying gas, recirculating air discharged from the web area by the suction chamber into the nozzle box through the distribution chamber, and adding with substitute air, to be fed towards the web.

20. A method according to claim 18, wherein a flow of drying gas is straightened in the nozzle box by restricting the flow of drying gas in a transverse direction of the web as drying gas flows through the nozzle element toward the web, for at least one of eliminating and substantially reducing a velocity component transverse to the travelling direction of the web.

21. A method according to claim 20, wherein the flow of drying gas is straightened in the nozzle element so that the velocity component for drying gas, as it discharges from the nozzle aperture, projected to a plane of the web, forms an angle with the travelling direction of the web which is smaller than 10°.

22. A method according to claim 20, wherein the flow of drying gas is straightened in the nozzle element so that the velocity component for drying gas, as it discharges from the nozzle aperture, projected to a plane of the web, forms an angle with the travelling direction of the web which is smaller than 5°.

* * * * *